US009596906B2

(12) United States Patent
Lee

(10) Patent No.: US 9,596,906 B2
(45) Date of Patent: Mar. 21, 2017

(54) ARTICLE OF FOOTWEAR WITH CONCAVE PORTION

(71) Applicant: ACTION SPORTS EQUIPMENT, INC., Placentia, CA (US)

(72) Inventor: Sang Jeong Lee, Fullerton, CA (US)

(73) Assignee: ACTION SPORTS EQUIPMENT, INC., Placentia, CA (US)

( * ) Notice: Subject to any disclaimer, the term of this patent is extended or adjusted under 35 U.S.C. 154(b) by 61 days.

(21) Appl. No.: 14/694,605

(22) Filed: Apr. 23, 2015

(65) Prior Publication Data

US 2016/0309840 A1 Oct. 27, 2016

(51) Int. Cl.
*A43B 13/14* (2006.01)
*A43B 5/14* (2006.01)
*A43B 13/42* (2006.01)

(52) U.S. Cl.
CPC ..... *A43B 13/14* (2013.01); *A43B 5/14* (2013.01); *A43B 13/42* (2013.01)

(58) Field of Classification Search
CPC ..... A43B 13/14; A43B 13/42; A43B 13/28; A43B 13/41; A43B 13/00; A43B 13/145; A43B 13/146; A43B 5/14; A43B 5/145
USPC ..... 36/12, 25 R, 103, 131, 134, 3 B
See application file for complete search history.

(56) References Cited

U.S. PATENT DOCUMENTS 3,100,354 A * 8/1963 Herman ..... A43B 13/14 36/25 R
3,305,947 A * 2/1967 Kalsoy ..... A43B 3/30 36/144
4,506,463 A * 3/1985 Chassaing ..... A43B 5/14 36/131
4,739,564 A * 4/1988 Eser ..... A43B 5/14 36/131
5,142,797 A 9/1992 Cole, III ..... 36/113
5,205,056 A * 4/1993 Okajima ..... A43B 5/14 36/131
5,363,573 A * 11/1994 Kilgore ..... A43B 5/14 36/131
5,417,128 A * 5/1995 Beyl ..... B62M 3/086 36/131
5,505,111 A * 4/1996 Nagano ..... B62M 3/086 36/131
5,557,985 A * 9/1996 Nagano ..... B62M 3/086 74/594.4
5,685,093 A * 11/1997 Lin ..... A43B 1/0054 36/131
5,687,492 A * 11/1997 Muraoka ..... A43B 5/14 36/11.5
5,822,889 A * 10/1998 Ueda ..... A43B 5/14 36/131

(Continued)

*Primary Examiner* — Shaun R Hurley
*Assistant Examiner* — Bao-Thieu L Nguyen
(74) *Attorney, Agent, or Firm* — Stein IP, LLC

(57) ABSTRACT

The present subject matter is directed to an article of footwear for cycling. The article of footwear includes an upper comprising an opening, a midsole in contact with the upper, and an outsole in contact with the midsole. At least one of the midsole and the outsole comprises a concave portion in at least a midfoot region of the article of footwear. An apex of the concave portion in at least one of the midsole and the outsole is configured to come into contact with a pedal of a bicycle when the concave portion is pressed by a foot against the pedal.

9 Claims, 7 Drawing Sheets

(56) References Cited

U.S. PATENT DOCUMENTS 5,878,514 A * 3/1999 Ueda ..... A43B 5/14 36/131
5,924,220 A * 7/1999 Ueda ..... A43B 5/14 36/131
5,943,795 A * 8/1999 Ueda ..... A43B 5/14 36/131
6,006,451 A * 12/1999 Morris ..... A43B 1/0027 36/107
6,041,525 A * 3/2000 Kelley ..... A43B 1/0027 36/107
6,195,918 B1 * 3/2001 Kelley ..... A43B 1/0027 36/107
6,244,136 B1 * 6/2001 Chen ..... A43B 5/14 36/131
6,247,251 B1 * 6/2001 James ..... A43B 5/00 36/100
6,260,291 B1 * 7/2001 Farys ..... A43B 5/14 36/107
6,357,145 B1 * 3/2002 James ..... A43B 1/0027 36/103
6,467,198 B1 * 10/2002 James ..... A43B 1/10 36/115
6,494,117 B1 * 12/2002 Bryne ..... B62M 3/086 36/132
6,935,055 B2 * 8/2005 Oorei ..... A43B 5/001 36/129
7,017,445 B2 * 3/2006 Bryne ..... B62M 3/086 74/560
7,178,272 B2 * 2/2007 Xie ..... A43B 5/14 36/131
7,219,451 B2 * 5/2007 Chretien ..... A43B 5/14 36/131
7,343,702 B2 * 3/2008 Chao ..... A43B 5/14 36/131
7,536,810 B2 * 5/2009 Jau ..... A43B 5/14 36/131
7,934,327 B2 * 5/2011 Gebhard ..... A43B 5/14 36/131
8,074,377 B2 * 12/2011 Nishiwaki ..... A43B 7/142 36/25 R
8,272,150 B2 * 9/2012 Bryne ..... A43B 5/14 36/131
8,418,379 B2 * 4/2013 Nishiwaki ..... A43B 7/142 36/25 R
8,745,900 B2 * 6/2014 Bryne ..... A43B 5/14 36/131
9,254,016 B2 * 2/2016 Tews ..... A43B 3/24
2004/0148809 A1 * 8/2004 Kikuta ..... A43B 5/14 36/131
2004/0205981 A1 10/2004 Cole ..... 36/30 R
2006/0137228 A1 * 6/2006 Kubo ..... A43B 3/0036 36/103
2007/0051020 A1 * 3/2007 Tajima ..... A43B 3/0042 36/132
2010/0192421 A1 8/2010 Kerns et al. ..... 36/3 B
2010/0269374 A1 * 10/2010 Hsieh ..... A43B 5/14 36/25 R
2011/0138658 A1 * 6/2011 Ueda ..... A43B 5/14 36/131
2011/0179672 A1 * 7/2011 Cheng ..... A43B 7/141 36/71
2011/0197468 A1 * 8/2011 Kubo ..... A43B 3/0036 36/28
2011/0277351 A1 * 11/2011 Scoledes ..... A43B 5/10 36/103
2012/0000095 A1 1/2012 Torrance ..... 36/132
2012/0017471 A1 * 1/2012 Tews ..... A43B 3/246 36/131
2013/0205621 A1 * 8/2013 Torrance ..... A43B 5/14 36/114
2014/0068880 A1 3/2014 Torrance et al. ..... 12/146 B
2014/0075786 A1 * 3/2014 Bryne ..... A43B 5/14 36/25 R
2014/0190041 A1 * 7/2014 Wu ..... A43B 23/222 36/25 R
2014/0196309 A1 7/2014 Wyner et al. ..... 36/44
2014/0259791 A1 * 9/2014 Stull ..... A43B 13/223 36/103
2014/0259796 A1 * 9/2014 Hillyer ..... A43B 5/14 36/134
2015/0157088 A1 * 6/2015 Seo ..... A43B 1/0018 36/25 R
2015/0189943 A1 * 7/2015 Fournier ..... A43B 7/1405 36/103
2015/0223561 A1 * 8/2015 Kilgore ..... A43B 13/14 36/25 R
2016/0000180 A1 * 1/2016 Cook ..... A43B 5/06 36/103
2016/0037858 A1 * 2/2016 Foxen ..... A43B 13/125 36/103
2016/0073726 A1 * 3/2016 Wu ..... A43B 5/14 36/131
2016/0081422 A1 * 3/2016 Garneau ..... A43B 1/0081 36/7.2

* cited by examiner

ARTICLE OF FOOTWEAR WITH CONCAVE PORTION

BACKGROUND OF THE INVENTION

1. Field of the Invention

The present disclosure relates to an article of footwear and, more particularly, to an article of footwear for active engagement with a platform.

2. Background of the Invention

Many activities are benefited by proper, dedicated footwear. For example, cycling, climbing, running, rowing, and the like, benefit from footwear designed for the particular activities.

FIG. 1 illustrates an article of footwear according to the related art. An article of footwear, for example, shoe 10 as shown in FIG. 1, generally includes an upper 12, a midsole 14, and an outsole 16. The shoe 10 is a common shoe for use with a platform or flat pedal in association with cycling, for example, downhill mountain biking. The upper 12, the midsole 14, and the outsole 16 may be attached according to various types and methods to define the general shape of the shoe 10. A tongue 24 is attached to the upper 12, and the tongue 24 and the upper 12 define an opening 18 through which a foot is inserted to wear the shoe 10. Closures, such as a strap 20 or laces 22, may be disposed over the tongue to secure and tighten the upper 12 about a foot.

As shown in FIG. 1, the outsole 16 has a generally planar shape such that a bottom surface 17 of the outsole 16, opposite the upper 12, has a substantially planar surface. The outsole 16 may include lugs and/or a tread pattern and maintain the substantially planar shape of the bottom surface 17 of the outsole 16. A side portion 19 of the outsole 16 may extend away from the bottom surface 17 up a side of the midsole 14 and/or the upper 12 to provide additional protection from wear. For example, the side portion 19 may extend up a front of the shoe 10 in a toe area of the shoe 10.

The shoe 10 of the related art, as shown in FIG. 1, provides a substantially planar bottom surface 17 of the outsole 16 as an area of a contact patch for contact of the outsole 16 with a surface, for example, a bicycle pedal. In order to increase the security of the contact between a shoe and a bicycle pedal, many shoes are provided with an outsole having a softer rubber, which decreases the lifespan of the outsole of the shoe due to the softer rubber wearing faster than a harder, more durable rubber. In many cycling applications, for example, mountain biking, outsoles of shoes are subjected to wear from pedals while riding, concrete and asphalt while walking, and even dirt and rocks while walking on a trail. Meanwhile, as a hardness of a rubber for an outsole is increased for an increased lifespan, a security of contact with, for example, a pedal, is decreased. As such, an outsole of a cycling shoe should be durable while providing sufficient security of contact with a pedal. Moreover, it is difficult for a barefoot to exert a maximum, uniform pressure onto the pedal due to the gap formed between the barefoot and the planar bottom surface 17 of the outsole 16. This also frequently weakens the frictions between the pedal and the planar bottom surface 17 of the outsole 16.

SUMMARY OF THE INVENTION

An aspect of the present subject matter is directed to an article of footwear, includes: an upper comprising an opening; a midsole in contact with the upper; and an outsole in contact with the midsole, wherein at least one of the midsole and the outsole comprises a concave portion in at least a midfoot region of the article of footwear.

In the article of footwear according to the present subject matter, at least one of the midsole and the outsole includes a convex portion in at least a toe region of the article of footwear.

In the article of footwear according to the present subject matter, a height of the concave portion is about half of a height of the convex portion, the height of the concave portion and the height of the convex portion being taken with respect to a surface on which the article of footwear is disposed.

In the article of footwear according to the present subject matter, the concave portion is symmetric about an apex of the concave portion.

In the article of footwear according to the present subject matter, the concave portion comprises a first angle closer to a toe region of the article of footwear and a second angle closer to a heel region of the article of footwear, the first angle and the second angle be about the same and being taken with respect to a surface on which the article of footwear is disposed.

In the article of footwear according to the present subject matter, the concave portion comprises a major curve in a lengthwise direction of the article of footwear, the lengthwise direction being a toe to heel direction with respect to the article of footwear.

In the article of footwear according to the present subject matter, the concave portion comprises a major curve in a widthwise direction of the article of footwear, the widthwise direction being perpendicular to a toe to heel direction with respect to the article of footwear.

The article of footwear according to the present subject matter further includes a stiffener disposed in at least the midfoot region of the article of footwear.

In the article of footwear according to the present subject matter, the stiffener comprises a curvature opposite to a curvature of the concave portion.

In the article of footwear according to the present subject matter, the stiffener extends from the midfoot region of the article of footwear to a forefoot region of the article of footwear and comprises at least one hole through which a cleat attachment plate extends to be attachable to a cleat.

The article of footwear according to the present subject matter further includes a cleat attachment plate positionable in at least the concave portion of the article of footwear.

In the article of footwear according to the present subject matter, the outsole comprises a tread pattern in at least the concave portion, the tread pattern actively engaging a surface on which the article of footwear is disposed when a force is applied to the article of footwear.

In the article of footwear according to the present subject matter, the concave portion is formed by differences in thicknesses of at least one of the midsole and the outsole, the differences in thicknesses being taken with respect to at least one of a forefoot region and a heel region of the article of footwear.

In the article of footwear according to the present subject matter, the article of footwear is particularly configured for cycling, and wherein an apex of the concave portion in at least one of the midsole and the outsole is configured to come into contact with a pedal of a bicycle in an active engagement with the pedal.

Another aspect of the present subject matter is directed to a stiffener for an article of footwear, comprising: a forefoot region and a midfoot region, the midfoot region comprising a curvature; and at least one hole through which a cleat attachment plate is extendable to be attachable to a cleat, the at least one hole extending in both the forefoot region and the midfoot region.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
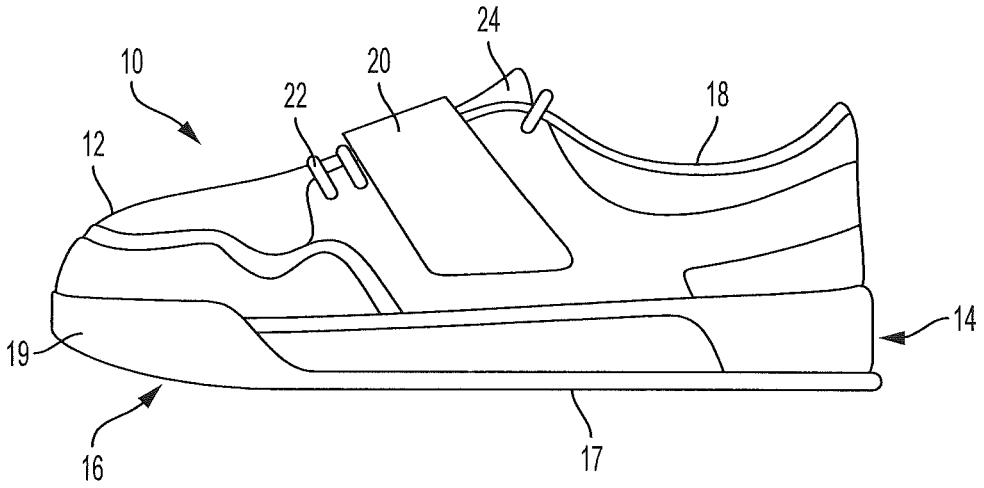
FIG. 1 Prior Art
FIG. 1 illustrates an article of footwear according to the related art.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
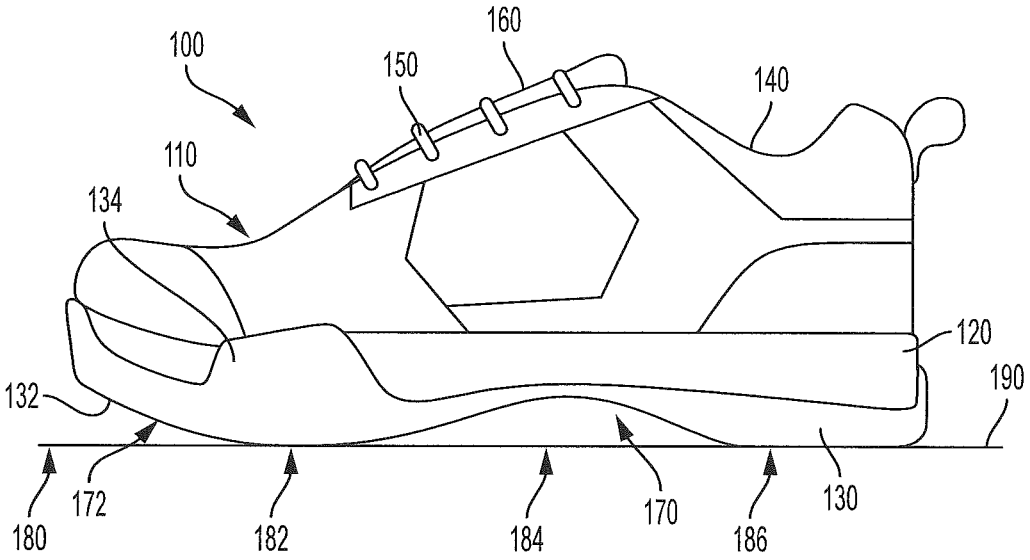
FIG. 2 illustrates an article of footwear according to aspects of the present invention.

FIG. 2 illustrates an article of footwear according to aspects of the present invention. Specifically, FIG. 2 illustrates an article of footwear, for example, a shoe 100, which includes an upper 110, a midsole 120, and an outsole 130. The upper 110, the midsole 120, and the outsole 130 may be attached according to various types and methods to define the general shape of the shoe 100. For example, the upper 110, the midsole 120, and the outsole 130 may be fastened or secured together by stitches, sewing, adhesives, heat welding, and the like. Although the upper 110, the midsole 120, and the outsole 130 are described herein individually, the shoe 100 need not include each of the upper 110, the midsole 120, and the outsole 130, and one or more of the upper 110, the midsole 120, and the outsole 130 may be combined to form the shoe 100. For example, the midsole 120 and the outsole 130 may be integrated. Further, each of the upper 110, the midsole 120, and the outsole 130 need not be completely present as shown in FIG. 2, but may be only partially present. For example, the upper 110 need not be complete as shown in FIG. 2 and may only be partially present.

The upper 110 of the shoe 100 may include a tongue 160 connected to the upper 110 to define, in combination with the upper 110, an opening 140 through which a foot is inserted to wear the shoe 100. Closure mechanisms, for example, laces 150 may be provided to extend between portions of the upper 110 over the tongue 160 to secure the shoe 100 to a foot. Additional or other closure mechanisms may secure the shoe 100 to a foot, for example, straps, ratchets, hooks, and the like may be used. Although the opening 140 of the shoe 100 is shown to be about ankle height, aspects need not be limited thereto such that the opening 140 may be lower or higher, for example, the 100 may be provided in as a high top style shoe.

The upper 110 may be a wrap upper and includes any material appropriate for construction of a shoe upper and may include vents, padding, and the like. For example, the upper 110 may include one or more of a natural or synthetic leather, a rubber material, a polymeric material, a polymeric mixture, a polymeric alloy, a laminate, a natural or synthetic textile material, a mesh material, or a combination thereof. The upper 110 may include multiple pieces of material sewn, adhered, welded, or the like together.

The midsole 120 includes any material appropriate for construction of a shoe midsole and may include, for example, a leather, a foam, a canvas, a rubber, an elastomer, a polyester, a vinyl, a nylon, a nylon textile, a thermoplastic, a composite, a polymer, a polyurethane foam, a foam rubber, an expanded rubber, a laminate, a polymeric material, a polymeric mixture, a polymeric alloy, a natural rubber, a synthetic rubber, and the like, and combinations thereof. For example, the midsole 120 may be an ethylene copolymer, e.g., ethylene-vinyl acetate (EVA). The midsole 120 may include one or more pieces configured together to form the midsole 120.

The outsole 130 includes any material appropriate for construction of a shoe outsole and may include, for example, a natural rubber, a synthetic rubber, and/or composite mixtures thereof. The rubber for the outsole 130 may be selected for properties such as flexibility and/or durability. The outsole 130 includes a bottom surface 132 opposite the upper 110 and one or more side portions 134. Aspects need not be limited thereto such that the outsole 130 need not include any side portions 134 or may include a side portion that extends about the entirety of the shoe 100. The side portions 134 may extend from the bottom surface 132 of the outsole 130 up at least a portion of the midsole 120 and may extend to the upper 110. Further, the side portions 134 need not be limited to sides of the shoe 100 but may also be present in the front and back portions of the shoe 100.

The shoe 100 may further include an insole (not shown) disposed in a cavity between the upper 110 and the midsole 120 to provide for comfort and support of a foot disposed also in the cavity. The insole may be made of any material appropriate for construction of an insole for a shoe and may be provided separately or integrally with the shoe 100.

Remaining in FIG. 2, a toe region 180, a forefoot (ball) region 182, a midfoot (arch) region 184, and a heel region 186 are indicated with respect to the shoe 100. The upper 110 forms a toe box to house toes of a foot disposed in the shoe 100 in the toe region 180. The forefoot region 182 is disposed between the toe region 180 and the midfoot region 184 and generally corresponds to a portion of a foot disposed in the shoe 100 in which the toes join the rest of the foot. In other words, the forefoot region 182 corresponds, generally, to a portion of the shoe 100 in which the metatarsophalangeal articulations of a foot disposed in the shoe 100 are located.

The midfoot region 184 is disposed between the forefoot region 182 and the heel region 186 and generally corresponds to a portion of the shoe 100 in which an arch of a foot disposed in the shoe 100 is located. The heel region 186 of the shoe 100 is disposed adjacent to the midfoot region 184 and at an opposite end of the shoe 100 from the toe region 180 in a lengthwise direction of the shoe 100. The opening 140 of the upper 110 is disposed in the heel region 186 of the shoe 100.

The toe region 180 of the shoe 100 includes a convex region to curve the bottom of the shoe up from the forefoot region 182. Specifically, the bottom surface 132 of the outsole 130 includes a convex portion 172 that is generally convex to curve toward the upper 110 and away from a surface 190 on which the shoe 100 is disposed. The convex portion 172 of the bottom surface 132 may be wholly contained within the toe region 180 or may begin in the forefoot region 182 and extend into and/or through the toe region 180. Further, the curvature of the convex portion 172 may be constant or may include portions of an increased, increasing, decreased, decreasing curvature, or generally planar portions such that the curvature of the convex portion 172 may be continuous or discontinuous.

The outsole 130 may include a tread pattern formed or disposed therein or thereon. The tread pattern may include lugs. In the forefoot region 182, the outsole 130 may include flex grooves to provide for flexibility of the outsole 130 and also the shoe 100. The flex grooves of the outsole 130 may be only a relative thinning of the outsole 130 or may be a complete lack of material of the outsole 130. Further, the flex grooves may extend laterally or lengthwise or along various paths in the outsole 130. And, the flex grooves may extend from an edge of the outsole 130 and may extend to another edge of the outsole 130 such that the outsole may include multiple parts or portions forming the outsole 130. The flex grooves may extend into the midsole 120, but aspects need not be limited thereto. The flex grooves may extend into other or cross one or more regions of the shoe 100; for example, the flex grooves may extend from the toe region 180 to the heel region 186. The number and location of the flex grooves may be determined according to a desired flexibility of the shoe 100.

The midfoot region 184 of the shoe 100 includes a concave region to curve the bottom of the shoe up between the forefoot region 182 and the heel region 186. Specifically, the bottom surface 132 of the outsole 130 includes a concave portion 170 that is generally concave to curve the bottom surface 132 toward the upper 110 and away from the surface 190 on which the shoe 100 is disposed. The concave portion 170 of the midfoot region 184 may be wholly included in the midfoot region 184 or may extend into and/or across other regions. Further, the curvature of the concave portion 170 may be constant or may include portions of an increased, increasing, decreased, decreasing curvature, or generally planar portions such that the curvature of the concave portion 170 may be continuous or discontinuous. The concave portion 170 may have a major curve in a lengthwise direction of the shoe 100, i.e., in a toe to heel direction of the shoe 100, and the concave portion 170 may have a minor curve in a widthwise direction of the shoe 100 generally perpendicular to the major curve of the concave portion 170. However, aspects need not be limited thereto such that the concave portion 170 may have major and minor curves in directions at angles of, for example, 70 degrees or 45 degrees, and the concave portion 170 may have more than two directions of curvature such that there may be plural minor curves.

The concave portion 170 and/or the convex portion 172 may or may not be, or may be partially, preloaded to resist straightening of the respective concavity and convexity of the concave portion 170 and the convex portion 172. For example, the concave portion 170 and/or the convex portion 172 may not be preloaded or may have a low preload, which may help with engagement of outsole 130 with a pedal as described herein. The preload of the concave portion 170 and/or the convex portion 172 may be provided by changes in material properties or inserts in the midsole 120 and/or the outsole 130 of the shoe 100.

At least one of the concave portion 170 and the convex portion 172 may be formed by or may comprise a relatively thinner portion of the midsole 120 and/or the outsole 130. For example, if the toe region 180 includes the convex portion 172 and the midfoot region 184 includes the concave portion 170, the midsole 120 and/or the outsole 130 may be relatively thinner in the toe region 180 and the midfoot region 184 than in the forefoot region 182 and the heel region 186. Further, at least one of the concave portion 170 and the convex portion 172 may be wholly formed by the outsole 130 such that a contact portion between the midsole 120 and the outsole 130 in an area of the at least one of the concave portion 170 and the convex portion 172 may be generally planar. Although FIG. 2 illustrates the shoe 100 including both the concave portion 170 and the convex portion 172, aspects need not be limited thereto such that the shoe 100 may include only one of the concave portion 170 and the convex portion 172.

Figure 3:
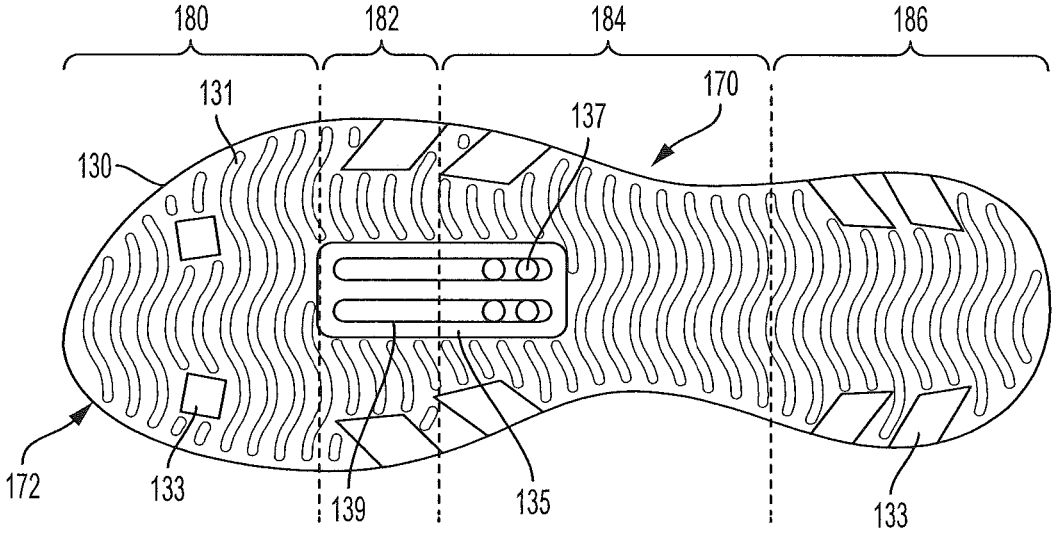
FIG. 3 is a bottom view of an outsole of an article of footwear according aspects of the invention.

FIG. 3 is a bottom view of an outsole of an article of footwear according aspects of the invention. Specifically, FIG. 3 illustrates a bottom view of an outsole 130 of an article of footwear, for example, a shoe 100. A bottom surface 132 of the outsole 130 includes a tread pattern 131, which may include lugs 133, formed or disposed therein and/or thereon. The lugs 133 may be replaceable and separable from the shoe 100. The outsole 130 includes portions disposed in the toe region 180, the forefoot region 182, the midfoot region 184, and the heel region 186 of the shoe 100. The outsole 130 may include a void 135 disposed therein so as to provide sufficient space available for the attachment of a cleat to a cleat attachment plate 137, which is at least partially exposed via holes 139 in the outsole 130 and/or the midsole 120. The cleat may temporarily secure the shoe 100 to a pedal. The void 135 of the outsole 130 may be an absence of material that exposes the midsole 120 or may be a portion of the outsole 130 that is relatively thinner than other portions of the outsole 130. However, aspects need not be limited thereto such that the void 135 need not be any thinner and only be lacking at least one of the lugs 133 and the tread pattern 131. Further, the void 135 of the outsole 130 may be an absence of material that exposes a protection plate disposed between disposed between the outsole 130 and the midsole 120 to protect the outsole 130 and the midsole 120 from wear due to contact with a pedal.

The toe region 180 of the outsole 130 includes the convex portion 172, and the midfoot region 184 of the outsole 130 includes the concave portion 170. As shown in FIG. 3, the void 135 of the outsole 130 extends from a boundary between the toe region 180 and the forefoot region 182 into the midfoot region 184 so that a cleat attached to the cleat attachment plate 137 may be secured at locations in both the forefoot region 182 and the midfoot region 184. In other words, the void 135 of the outsole 130, the holes 139, and the cleat attachment plate 137 may be provided in at least one of the toe region 180, the forefoot region 182, the midfoot region 184, and the heel region 186 of the shoe 100.

Further, the void 135 may extend across an entire one of and into another of the toe region 180, the forefoot region 182, the midfoot region 184, and the heel region 186 of the shoe 100. However, the void 135 may only extend across a portion of one or more of the toe region 180, the forefoot region 182, the midfoot region 184, and the heel region 186 of the shoe 100. A cleat may be secured to the cleat attachment plate 137 at a location within the concave portion 170 of the midfoot region 184 of the shoe. More specifically, a cleat may be attached to the cleat attachment plate 137 in a region of the concave portion 170 closer to the toe region 180 than an apex of the concave portion 170. Such positioning of a cleat may reinforce proper pedal technique when, for example, traversing a log or bunny hopping while the secured cleat is engaged in a pedal. Further, the variability of the locations at which a cleat may be secured may provide a more natural and/or comfortable placement of a cleat.

Figure 4:
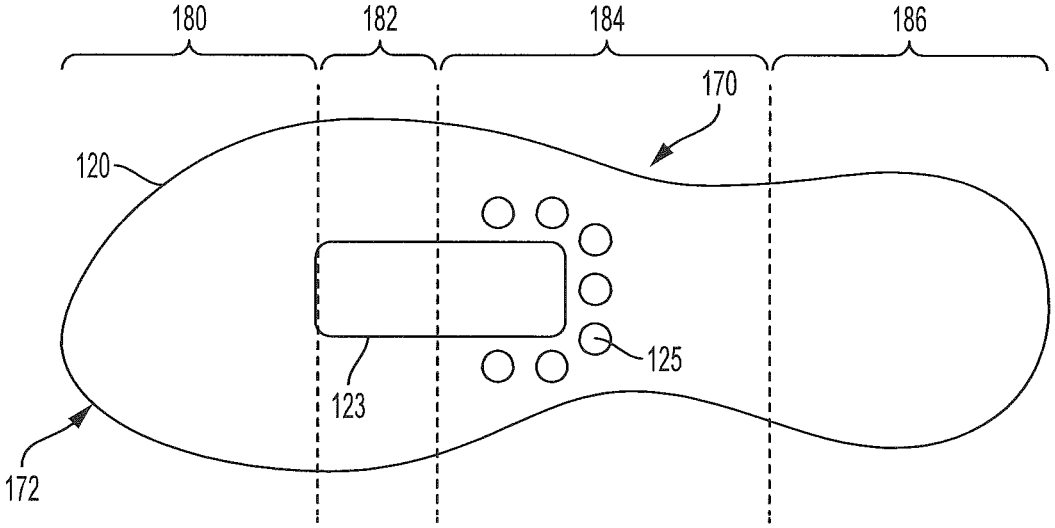
FIG. 4 is a bottom view of a midsole of an article of footwear according to aspects of the invention.

FIG. 4 is a bottom view of a midsole of an article of footwear according to aspects of the invention. Specifically, FIG. 4 illustrates a bottom view of a midsole 120 of an article of footwear, for example, a shoe 100. A bottom surface 122 of the midsole 120 is sewn, adhered, heat welded, or the like to the outsole 130, and, as such, is not normally visible in a fully constructed shoe 100. The bottom surface 122 of the midsole 120 is shown here, however, for purposes of illustration.

The midsole 120 includes portions disposed in the toe region 180, the forefoot region 182, the midfoot region 184, and the heel region 186 of the shoe 100. The midsole 120 includes a void 123 disposed therein to accommodate at least a portion of a cleat attachment system (not shown). The void 123 of the midsole 120 may correspond in location to the void 135 of the outsole 130 as shown in FIG. 3 such that the void 123 of the midsole 120 and the void 135 of the outsole 130 align to provide sufficient space available for the cleat attachment system and the attachment of a cleat thereto. The void 123 of the midsole 120 may be of a sufficient depth so that a most distal portion of an attached cleat does not extend beyond the bottom surface 132 of the outsole 130. Such a depth of the void 123 will prevent wear of the attached cleat when walking in the shoe 100 on an even surface.

As shown in FIG. 4, the void 123 of the midsole 120 extends from a boundary between the toe region 180 and the forefoot region 182 into the midfoot region 184 so that a cleat attached to the cleat attachment plate 137 may be secured at locations in both the forefoot region 182 and the midfoot region 184. Similar to the void 135 of the outsole 130 described with respect to FIG. 3, the void 123 of the midsole 120 may be provided in at least one of the toe region 180, the forefoot region 182, the midfoot region 184, and the heel region 186 of the shoe 100. Further, the void 123 may extend across an entire one of and into another of the toe region 180, the forefoot region 182, the midfoot region 184, and the heel region 186 of the shoe 100. However, the void 123 may only extend across a portion of one or more of the toe region 180, the forefoot region 182, the midfoot region 184, and the heel region 186 of the shoe 100.

Also as shown in FIG. 4, the midsole 120 includes holes 125 to provide for an adjusted or adjustable strength and/or flexibility of the midsole. For example, the holes 125 may not include any material, i.e., the portions of the midsole 120 corresponding to the holes 125 are removed, such that flexibility of the midsole 120 in the regions about the holes 125 is increased in flexibility with respect to a complete midsole with no empty holes. At least some of the holes 125 may be filled with, for example, a material having a higher density than a density of the midsole 120 to increase strength and/or decrease flexibility of the midsole 120 in the area of the holes 125. Further, the holes 125 may be selectively filled or empty so as to provide a desired strength and/or flexibility of the midsole 120.

In FIG. 4, the holes 125 are provided in a portion of the concave portion 170 in the midsole 120 of the midfoot region 184 of the shoe 100. In other words, the holes 125 may be disposed a region of the concave portion 170 closer to the toe region 180 than an apex of the concave portion 170. However, aspects need not be limited thereto such that the strength and/or flexibility of the midsole 120 may be tuned by placing holes, filled or unfilled, throughout the midsole 120, for example, in the convex portion in the midsole 120 of the toe region 180 of the shoe 100, in the forefoot region 182, or the heel region 186.

Portions of the bottom surface 122 of the midsole 120 may be exposed through flex grooves in the outsole 130. Further, the bottom surface 122 of the midsole 120 may include grooves therein such that flex grooves in the outsole 130 may correspond to or align with grooves in the bottom surface 122 of the midsole 120. Areas in which a groove is formed or disposed in the midsole 120 may be relatively thinner than other areas of the midsole 120 to increase or modify flexibility of the midsole 120 and of the shoe 100.

Figure 5:
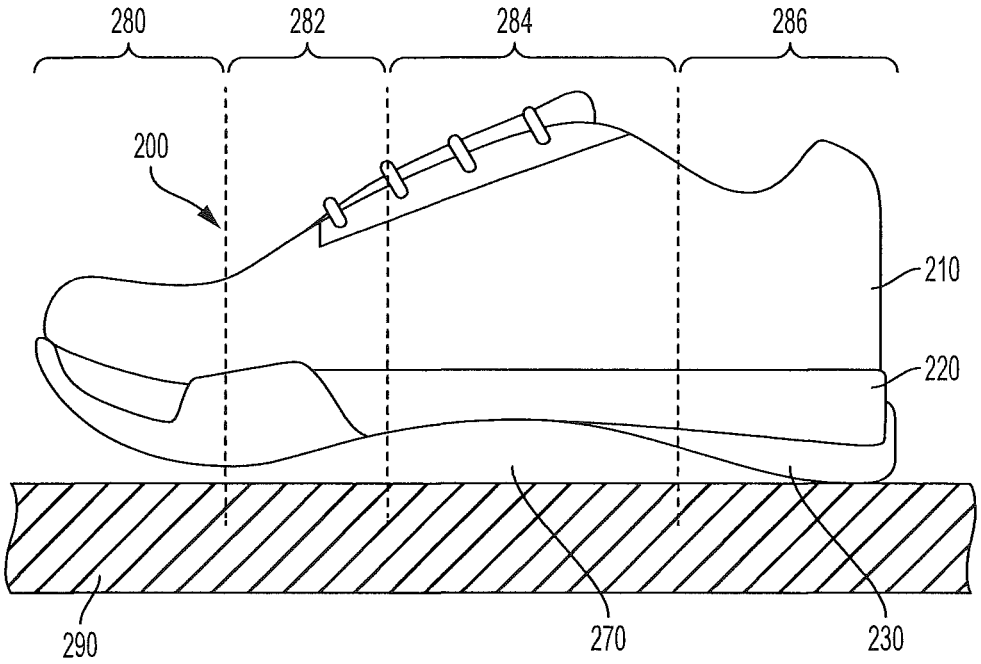
FIG. 5 illustrates an article of footwear according to aspects of the present invention.

FIG. 5 illustrates an article of footwear according to aspects of the present invention. Specifically, FIG. 5 illustrates an article of footwear, for example, a shoe 200, which includes an upper 210, a midsole 220, and an outsole 230. Features of the shoe 200 are similar to those described with respect to the shoe 100, and discussion of such features may be omitted. The outsole 230 includes a bottom surface 232 opposite the upper 210 and one or more side portions 234, and the outsole 230 may include one or more portions disposed on the midsole 220.

As shown in FIG. 5, a toe region 280, a forefoot (ball) region 282, a midfoot (arch) region 284, and a heel region 286 are indicated with respect to the shoe 200. The shoe 200 includes a concave portion 270 and a convex portion 272. Specifically, the bottom surface 232 of the outsole 230 includes the convex portion 272 that is generally convex to curve toward the upper 210 and away from a surface 290 on which the shoe 200 is disposed. The convex portion 272 of the bottom surface 232 may be wholly contained within the toe region 280. Further, the curvature of the convex portion 272 may be constant or may include portions of an increased, increasing, decreased, decreasing curvature, or generally planar portions such that the curvature of the convex portion 272 may be continuous or discontinuous.

Remaining in FIG. 5, the bottom surface 232 of the outsole 230 includes the concave portion 270 that is generally concave to curve the bottom surface 232 toward the upper 210 and away from the surface 290 on which the shoe 200 is disposed. The concave portion 270 extends at least from the forefoot region 282 through the midfoot region 284 and into the heel region 286. The concave portion 270 may begin its curvature in the toe region 280 and extend through the forefoot region 282 and the midfoot region 284 and into the heel region 286. Further, the curvature of the concave portion 270 may be constant or may include portions of an increased, increasing, decreased, decreasing curvature, or generally planar portions such that the curvature of the concave portion 170 may be continuous or discontinuous.

At least one of the concave portion 270 and the convex portion 272 may be formed by or may comprise a relatively thinner portion of the midsole 220 and/or the outsole 230.

For example, if the convex portion 272 is completely in the toe region 280 and the concave portion 270 extends from the toe region 280 through the forefoot region 282 and the midfoot region 284 and into the heel region 286, the midsole 220 and/or the outsole 230 may be relatively thinner in the convex portion 270 of the toe region 280 and the concave portion 270 of the toe region 280, the forefoot region 282, the midfoot region 284, and the heel region 286 than other portions of the toe region 280 and the heel region 286. If the convex portion 272 is in the toe region 280 and begins in the forefoot region 282, and the concave portion 270 extends from the forefoot region 282 through the midfoot region 284 and into the heel region 286, the midsole 220 and/or the outsole 230 may be relatively thinner in the convex portion 270 of the toe region 280 and the concave portion 270 of the forefoot region 282, the midfoot region 284, and the heel region 286 than other portions of the forefoot region 282 and the heel region 286.

The concave portion 270 and/or the convex portion 272 may or may not be, or may be partially, preloaded to resist straightening of the respective concavity and convexity of the concave portion 270 and the convex portion 272. For example, the concave portion 270 and/or the convex portion 272 may not be preloaded or may have a low preload, which may help with engagement of outsole 230 with a pedal as described herein. The preload of the concave portion 170 and/or the convex portion 172 may be provided by changes in material properties or inserts in the midsole 220 and/or the outsole 230 of the shoe 200.

Although FIG. 5 illustrates the shoe 200 including both the concave portion 270 and the convex portion 272, aspects need not be limited thereto such that the shoe 200 may include only one of the concave portion 270 and the convex portion 272.

Figure 6:
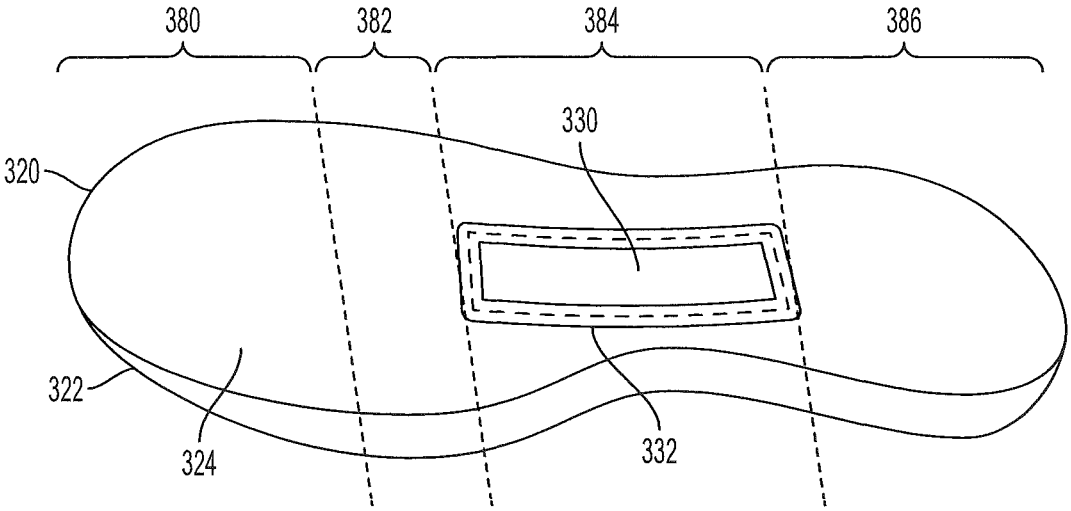
FIG. 6 is a perspective view of a midsole of an article of footwear according to aspects of the present invention.

FIG. 6 is a perspective view of a midsole of an article of footwear according to aspects of the present invention. FIG. 6 illustrates a midsole 320 of an article of footwear, for example, a shoe. The midsole 320 may be made, formed, or constructed by any of the methods and from any of the materials described herein but aspects are not limited thereto. Further, the midsole 320 may be used in any of the shoes described herein and may include features of other midsoles described herein, but aspects are not limited thereto. For example, the midsole 320 may include a concave portion and/or a convex portion as described herein.

The midsole 320 includes a bottom surface 322 and a top surface 324. An upper may be attached, secured, or integrated with the top surface 324 of the midsole 320. An outsole may be attached, secured, or integrated with the bottom surface 322 of the midsole 320. The midsole 320 may include a concave portion and/or a convex portion similar to respective concave portions and convex portions described herein. However, aspects need not be limited thereto such that the midsole 320 may be attached or adhered to an outsole having a concave portion and/or a convex portion similar to as described herein, or the midsole 320 may combine with an outsole to form a concave portion and/or a convex portion similar to as described herein.

As shown in FIG. 6, a toe region 380, a forefoot (ball) region 382, a midfoot (arch) region 384, and a heel region 386 are indicated with respect to the midsole 320.

The midsole 320 includes a stiffener 330 disposed therein. The stiffener 330 may be a shank and may be made of any material appropriate for making a shank, for example, steel, aluminum, carbon fiber, and the like. The stiffener 330 is disposed in a stiffener support 332. As shown in FIG. 6, edges of the stiffener 330 are disposed in the stiffener support 332. The stiffener support 332 is disposed about an entirety of a periphery of the stiffener 330 but aspects are not limited thereto such that the stiffener support 332 may include two portions disposed only at opposite ends of the stiffener 330 or the stiffener support 332 may only be provided at sides of the stiffener 330. The stiffener support 332 may be formed of any material suitable for stiffener support 332 and may include a leather, a foam, a canvas, a rubber, an elastomer, a polyester, a vinyl, a nylon, a nylon textile, a thermoplastic, a composite, a polymer, a polyurethane foam, a foam rubber, an expanded rubber, a laminate, a polymeric material, a polymeric mixture, a polymeric alloy, a natural rubber, a synthetic rubber, and the like, and/or composite mixtures thereof.

The stiffener 330 and the stiffener support 332 may be disposed in a void in the midsole 320. The void may be disposed in the midfoot region 384 of the midsole such that the stiffener 330 is disposed in the midfoot region 384. The stiffener support 332 may be disposed wholly or partially in the midfoot region 384 or adjacent regions. Further the stiffener 330 and the stiffener support 332 may extend into and/or throughout the toe region 380, the forefoot region 382, the midfoot region 384, and the heel region 386, and/or may be combined with other features disclosed herein. For example, the stiffener support 332 may be separate from or integral with the midsole 320, and the stiffener support 332 may be made of the same material as the midsole 320. Although made of a same material, properties of the stiffener support 332 may be different from those of the midsole 320; for example, the stiffener support 332 may be of a higher density than the midsole 320.

The void in which at least the stiffener 330 is disposed may be absent of material except for the stiffener 330 and the stiffener support 332 or may include material that is the same as or different from the midsole 320. For example, the void may include a lower density and/or more flexible material than the midsole 320 to allow for easier movement and reaction of the stiffener 330.

The stiffener 330, as shown in FIG. 6, is illustrated as having a generally rectangular shape. The stiffener 330 may be curved in a direction opposite to a curvature of the concave portion 370 of the midsole 320. The curvature of the stiffener 330 allows for the stiffener 330 to dampen vibrations and/or impacts on the bottom surface 322 of the midsole 320. The stiffener 330 may be preloaded in a direction opposite to a preload, if any, or a concavity of the concave portion 370.

Although shown and described as being within the midsole 320, aspects need not be limited thereto such that the stiffener 330 and stiffener support 332 may be disposed between the midsole 320 and an outsole attached thereto. For example, a contact portion between the midsole 320 and an outsole may be generally planar in an area in which the stiffener 330 and the stiffener support 332 are disposed. In such case, a concave portion may be formed by differences in thickness in the outsole, and the stiffener 330 may have a curvature opposite to the curvature of the concave portion of the outsole.

Figure 7:
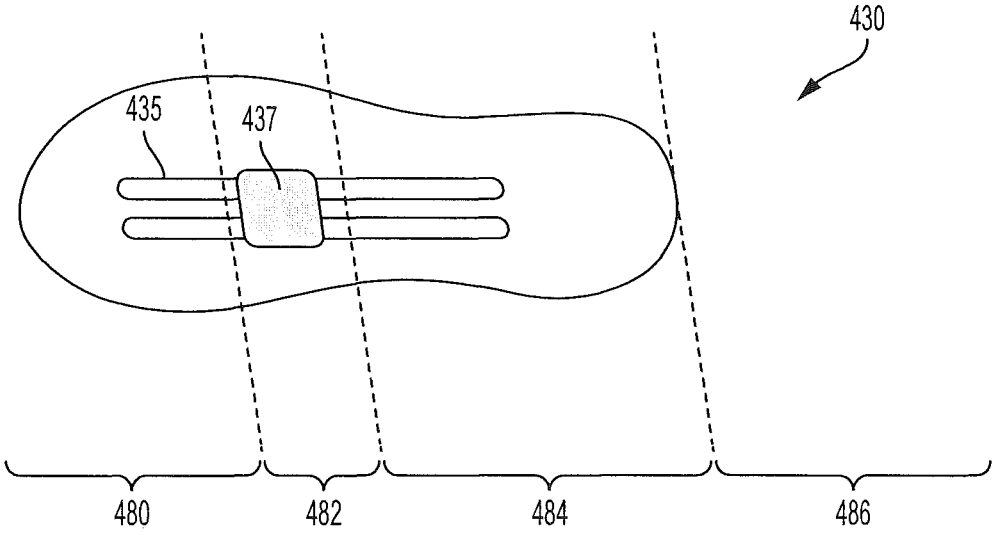
FIG. 7 is a perspective view of a stiffener of an article of footwear according to aspects of the present invention.

FIG. 7 is a perspective view of a stiffener of an article of footwear according to aspects of the present invention. FIG. 7 illustrates a midsole stiffener 430 of an article of footwear, for example, a shoe. Similar to as described elsewhere herein, the stiffener 430 may be disposed at least partially in at least a partial void in a midsole and/or may be disposed between the midsole and an outer.

A toe region 480, a forefoot (ball) region 482, a midfoot (arch) region 484, and a heel region 486 are indicated with respect to the stiffener 430. As shown in FIG. 7, the stiffener 430 may extend from inside the toe region 480 and through the forefoot region 482 and the midfoot region 484. The stiffener 430 may extend into the heel region 486. The stiffener 430 may extend from a front edge of the forefoot region 482 to a back edge of the midfoot region 484. In at least the midfoot region 484, the stiffener 430 may have a curvature that is opposite to a curvature of a concave portion of a shoe of which the stiffener 430 is a portion similar to as described with respect to FIG. 6.

The stiffener 430 includes holes 435 through which at least a portion of a cleat attachment plate 437 or a portion of a cleat (not shown) extends so as to secure the cleat to the cleat attachment plate 437. The holes 435 may extend in both the forefoot region 482 and the midfoot region 484. The holes 435 may extend into the midfoot region 484 a sufficient length so that the attached cleat may be located within a concave portion of the shoe.

Figure 8:
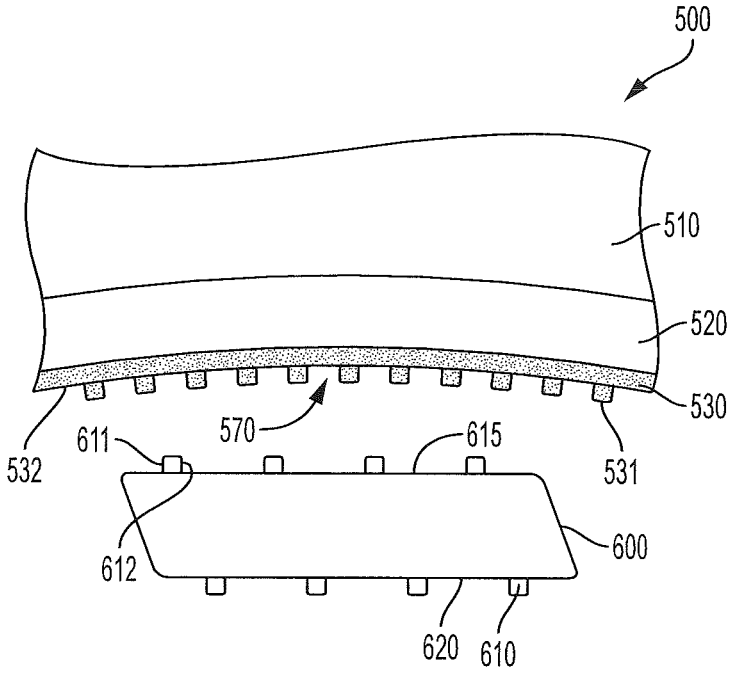
FIG. 8 is a side view of an article of footwear according to aspects of the present invention.

FIG. 8 is a side view of an article of footwear according to aspects of the present invention. Specifically, FIG. 8 illustrates an article of footwear, for example, a shoe 500, which includes an upper 510, a midsole 520, and an outsole 530. The outsole 530 of the shoe 500 includes a tread pattern 531 disposed on a or formed integrally with a bottom surface 532 of the outsole 530. The tread pattern 531 may include lugs. The tread pattern 531 interacts with surfaces on which the shoe 500 is placed and generates traction forces.

The shoe 500 may be placed on or contact a pedal 600 to operate, for example, a bicycle. The pedal 600 may be a platform pedal and may include a tread pattern as well and may include, for example, pins 610 that extend away from a top surface 615 and a bottom surface 620 of the pedal 600. The pins 610 and the top surface 615 of the pedal 600 interact with the tread pattern 531 and the bottom surface 532 of the outsole 530 in a concave portion 570 of the shoe 500 when the shoe 500 is pressed upon the pedal 600. The pins 610 include forward sides 611 disposed on a toe-side of the pedal 600 and rear sides 612 disposed on a rear-side of the pedal 600.

Figure 9:
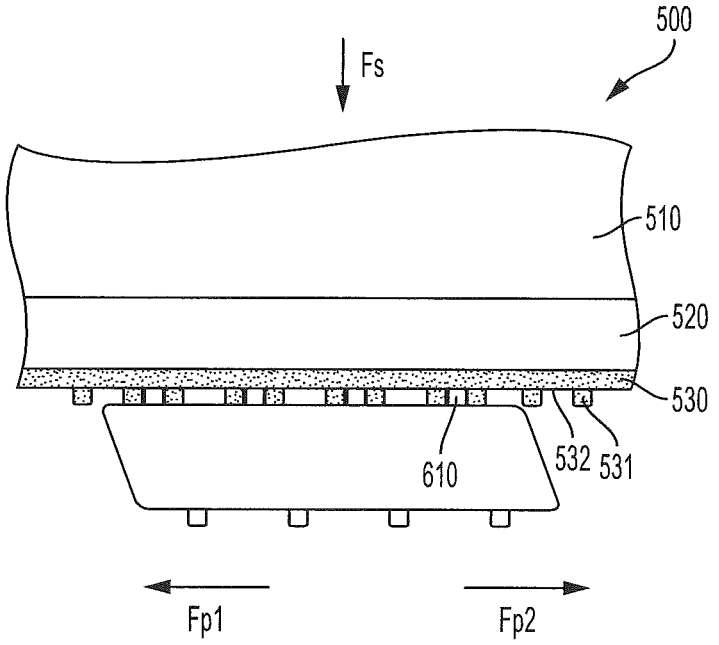
FIG. 9 is a side view of an article of footwear according to aspects of the present invention.

FIG. 9 is a side view of an article of footwear according to aspects of the present invention. Specifically, FIG. 9 illustrates an article of footwear, for example, the shoe 500 in active engagement with the pedal 600. The shoe 500 is pressed upon the pedal 600 by the weight of and/or force generated by a rider of the bicycle according to a force Fs. The force Fs, through the flexibility of the midsole 520 and the outsole 530, is translated into a first pedal force Fp1 and a second pedal force Fp2, which are directed in opposing directions. The first pedal force Fp1 and the second pedal force Fp2 extend in opposite directions about an apex of the concave portion 570 of the shoe 500 such that portions of the tread pattern 531 of the outsole 530 are pressed against forward sides 611 and rear sides 612 of the pins 610. For example, in a toe-side portion of the concave portion 570 of the shoe 500, the toe-side portions of the tread pattern 531 are forced via the first pedal force Fp1 in a toe-sided direction to press against rear sides 612 of the pins 610, and, in a heel-side portion of the concave portion 570 of the shoe 500, the heel-side portions of the tread 531 are forced via the second pedal force Fp2 in a heel-sided direction to press against forward sides 611 of the pins 610. The pressing of the toe-side and heel-side portions of the tread pattern 531 against the rear sides 612 and front sides 611 of the pins provide for a secure active engagement of the shoe 500 with the pedal 600. Further, although FIG. 9 may show the tread pattern 531 completely interlocking with the front side 611 and the rear sides 612 of the pins 610, aspects need not be limited thereto such that fewer treads of the tread patter 531 may be included or interacting with the pins 610.

Figure 10:
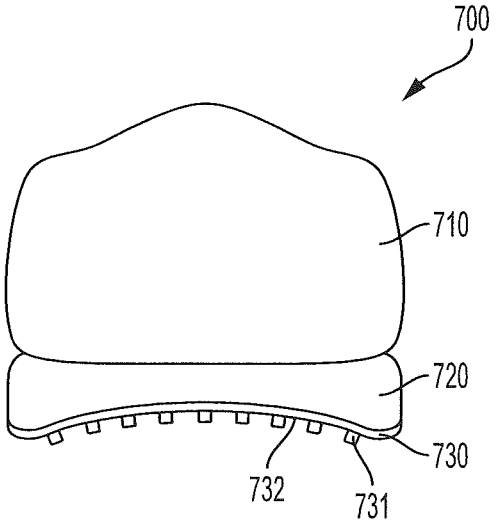
FIG. 10 is a cross-sectional view of an article of footwear according to aspects of the present invention.

FIG. 10 is a cross-sectional view of an article of footwear according to aspects of the present invention. Specifically, FIG. 10 illustrates a cross-sectional view of an article of footwear, for example, a shoe 700, which includes an upper 710, a midsole 720, and an outsole 730. The cross-section is taken in a widthwise direction with toe to heel being considered a lengthwise direction of the shoe 700. The cross-section as shown in FIG. 10 may be taken in a toe region, a forefoot region, a midfoot region, or heel region of the shoe 700. The shoe 700 also includes a concave portion 771. The concave portion 771 is curved in the widthwise direction; for example, from an inner side of the shoe 700 to an outer side of the shoe 700. The concave portion 771 is similar to the previously-described concave portions but differs from the previously-described concave portions in that concave portion 771 is curved in the widthwise of the shoe 700 direction whereas the previously-described concave portions are curved in a lengthwise direction of the shoes. The concave portion 771 may provide similar benefits of increased securing of engagement of the shoe 700 with a pedal in that the force of the pressing of the shoe 700 against the pedal will translate the force into sideways forces for engagement of a tread pattern 731 and a bottom surface 732 with pins of the pedal.

Figure 11:
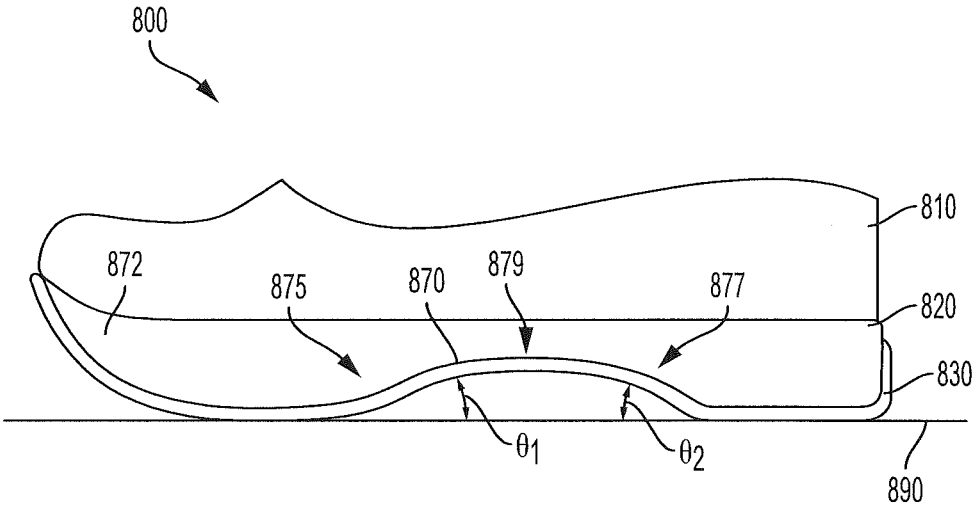
FIG. 11 is a side view of an article of footwear according to aspects of the present invention.

FIG. 11 is a side view of an article of footwear according to aspects of the present invention. Specifically, FIG. 11 illustrates an article of footwear, for example, a shoe 800, which includes an upper 810, a midsole 820, and an outsole 830. A bottom surface 832 of the outsole 830 includes a concave portion 870 and a convex portion 872. Although described as being included in the outsole 830, aspects are not limited thereto such that the concave portion 870 and the convex portion 872 may be included in the outsole 830 and/or the midsole 820. The concave portion 870 may have a first curvature 875 that begins at a first distance D1 from an end of a toe T of the shoe 800. The first distance dl may be about 3.5 cm to about 4.1 cm from the end of the toe T. The first curvature 875 may be adjacent to a flex point in the outsole 830, and the flex point of the outsole 830 may be closer to the toe T than the first curvature 870. The concave portion 870 may have a second curvature 877 that begins at a second distance D2 from an end of the toe T of the shoe 800. The second distance D2 may be about 13.5 cm to about 14.1 cm from the end of the toe T. In other words, the concave portion 870 of the shoe 800 may extend from about 3.5 cm to about 4.1 cm from the end of the toe T to about 13.5 cm to about 14.1 cm from the end of the toe T.

The first curvature 875 may form a first angle θ1 with a surface 890 on which the shoe 800 is disposed. The first angle θ1 may be about 5 to about 10 degrees. The second curvature 87 may form a second angle θ2 with the surface 890 on which the shoe 800 is disposed. The first angle θ2 may be about 5 to about 10 degrees. Further, the concave portion 870 may have a first height H1 above the surface 890 on which the shoe is disposed. The first height H1 of the concave portion 870 may be about 5 mm to about 9 mm. The convex portion 872 may extend to a second height H2 above the surface on which the shoe 800 is disposed. The second height H2 may be about 11 mm to about 17 mm. The first angle θ1 and the second angle θ2 may be the same. The concave portion 870 may be symmetric about the apex 879 of the concave portion 870. The second height H2 may be about twice the first height H1.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An article of footwear, comprising:

an upper comprising an opening;

a midsole in contact with the upper; and an outsole in contact with the midsole, wherein at least one of the midsole and the outsole comprises a concave portion in at least a midfoot region of the article of footwear, wherein the concave portion comprises a first major curve in a lengthwise direction of the article of footwear, the lengthwise direction being a toe-to-heel direction with respect to the article of footwear, wherein the concave portion comprises a second major curve in a widthwise direction of the article of footwear, the widthwise direction being substantially perpendicular to the toe-to-heel direction with respect to the article of footwear, wherein at least one of the midsole and the outsole comprises a convex portion in at least a toe region of the article of footwear, wherein a height of the concave portion is about half of a height of the convex portion, the height of the concave portion and the height of the convex portion being taken with respect to a surface on which the article of footwear is disposed.

2. The article of footwear of claim 1, wherein the concave portion is symmetric about an apex of the concave portion.

3. The article of footwear of claim 1, wherein the concave portion comprises a first angle closer to a toe region of the article of footwear and a second angle closer to a heel region of the article of footwear, the first angle and the second angle be about the same and being taken with respect to a surface on which the article of footwear is disposed.

4. The article of footwear of claim 1, wherein the concave portion is formed by differences in thicknesses of at least one of the midsole and the outsole, the differences in thicknesses being taken with respect to at least one of a forefoot region and a heel region of the article of footwear.

5. The article of footwear of claim 1, wherein the article of footwear is particularly configured for cycling, and wherein an apex of the concave portion in at least one of the midsole and the outsole is configured to come into contact with a pedal of a bicycle in an active engagement with the pedal.

6. An article of footwear, comprising:

an upper comprising an opening;

a midsole in contact with the upper; and an outsole in contact with the midsole, wherein at least one of the midsole and the outsole comprises a concave portion in at least a midfoot region of the article of footwear, wherein the concave portion comprises a first major curve in a lengthwise direction of the article of footwear, the lengthwise direction being a toe-to-heel direction with respect to the article of footwear, wherein the concave portion comprises a second major curve in a widthwise direction of the article of footwear, the widthwise direction being substantially perpendicular to the toe-to-heel direction with respect to the article of footwear, the article of footwear further comprising: a stiffener disposed in at least the midfoot region of the article of footwear, wherein the stiffener extends from the midfoot region of the article of footwear to a forefoot region of the article of footwear and comprises at least one hole through which a cleat attachment plate extends to be attachable to a cleat.

7. An article of footwear, comprising:

an upper comprising an opening;

a midsole in contact with the upper; and an outsole in contact with the midsole, wherein at least one of the midsole and the outsole comprises a concave portion in at least a midfoot region of the article of footwear, wherein the concave portion comprises a first major curve in a lengthwise direction of the article of footwear, the lengthwise direction being a toe-to-heel direction with respect to the article of footwear, wherein the concave portion comprises a second major curve in a widthwise direction of the article of footwear, the widthwise direction being substantially perpendicular to the toe-to-heel direction with respect to the article of footwear, the article of footwear further comprising: a cleat attachment plate positionable in at least the concave portion of the article of footwear.

8. An article of footwear, comprising:

an upper comprising an opening;

a midsole in contact with the upper; and an outsole in contact with the midsole, wherein at least one of the midsole and the outsole comprises a concave portion in at least a midfoot region of the article of footwear, wherein the concave portion comprises a first major curve in a lengthwise direction of the article of footwear, the lengthwise direction being a toe-to-heel direction with respect to the article of footwear, wherein the concave portion comprises a second major curve in a widthwise direction of the article of footwear, the widthwise direction being substantially perpendicular to the toe-to-heel direction with respect to the article of footwear, wherein the outsole comprises a tread pattern in at least the concave portion, the tread pattern actively engaging a surface on which the article of footwear is disposed when a force is applied to the article of footwear.

9. An article of footwear, comprising:

an upper comprising an opening;

a midsole in contact with the upper; and an outsole in contact with the midsole, wherein at least one of the midsole and the outsole comprises a concave portion in at least a midfoot region of the article of footwear, wherein the concave portion comprises a first major curve in a lengthwise direction of the article of footwear, the lengthwise direction being a toe-to-heel direction with respect to the article of footwear, wherein the concave portion comprises a second major curve in a widthwise direction of the article of footwear, the widthwise direction being substantially perpendicular to the toe-to-heel direction with respect to the article of footwear, the article of footwear further comprising: a stiffener disposed in at least the midfoot region of the article of footwear, wherein the stiffener comprises:

a forefoot region and a midfoot region, the midfoot region comprising a curvature; and at least one hole through which a cleat attachment plate is extendable to be attachable to a cleat, the at least one hole extending in both the forefoot region and the midfoot region.

* * * * *